US009821444B2

(12) United States Patent
Herisse et al.

(10) Patent No.: US 9,821,444 B2
(45) Date of Patent: Nov. 21, 2017

(54) ADJUSTABLE TOOL

(71) Applicant: Stanley Works (Europe) GmbH, Dubendorf (CH)

(72) Inventors: Jean-Christophe Herisse, Savigny sur Orge (FR); Xavier Molinier, Chatillon (FR)

(73) Assignee: Stanley Works (Europe) GmbH, Duebendorf (CH)

( * ) Notice: Subject to any disclaimer, the term of this patent is extended or adjusted under 35 U.S.C. 154(b) by 203 days.

(21) Appl. No.: 14/246,712

(22) Filed: Apr. 7, 2014

(65) Prior Publication Data

US 2014/0298959 A1 Oct. 9, 2014

(30) Foreign Application Priority Data

Apr. 8, 2013 (EP) ..... 13162813
Apr. 16, 2013 (EP) ..... 13163949

(51) Int. Cl.
*B25B 27/00* (2006.01)
*B25B 13/12* (2006.01)
*B25B 13/20* (2006.01)

(52) U.S. Cl.
CPC ..... *B25B 27/0042* (2013.01); *B25B 13/12* (2013.01); *B25B 13/20* (2013.01)

(58) Field of Classification Search
CPC ..... B25B 13/12; B25B 13/20; B25B 27/0042
See application file for complete search history.

(56) References Cited

U.S. PATENT DOCUMENTS 5,507,210 A * 4/1996 Paramest ..... B25B 13/52 81/155
8,950,298 B2 * 2/2015 Yang ..... F01M 11/03 81/128
2002/0017171 A1 * 2/2002 Chang ..... B25B 27/0042 81/133
2004/0182207 A1 * 9/2004 Wu ..... B25B 13/10 81/128
2014/0026721 A1 * 1/2014 Yang ..... F01M 11/03 81/128

FOREIGN PATENT DOCUMENTS

DE 202012104177 12/2012
FR 2692513 12/1993

OTHER PUBLICATIONS

European Search Report dated Nov. 11, 2016.

* cited by examiner

*Primary Examiner* — Robert Scruggs
(74) *Attorney, Agent, or Firm* — Caeden Drayton; Adan Ayala

(57) ABSTRACT

A tool (10) for rotating a screw-on oil filter cartridge, the tool comprising a driving member (28, 28*b*); gripping jaws (12*a*, 12*b*) movable in relation to each other for gripping an oil filter cartridge; a guide arrangement (13, 14*a*, 14*b*) for guiding the gripping jaws; means (16*a*, 16*b*) for biasing the gripping jaws towards each other; and a driving mechanism (28, 28*c*, 24, 22*a*, 22*b*, 20*a*, 20*b*, 21*a*, 21*b*) coupled to the driving (28*b*) member and gripping jaws (12*a*, 12*b*) for converting rotation into movement of the gripping jaws towards each other, into engagement with an oil filter cartridge and applying either screwing or unscrewing torque thereto. The tool comprises: a locking mechanism (30, 32, 28, 24) for releasably locking the gripping jaws (12*a*, 12*b*) at a pre-determined distance from each other; and a release actuator (28*a*) for unlocking the locking mechanism and releasing of the gripping jaws.

2 Claims, 10 Drawing Sheets

ADJUSTABLE TOOL

The present invention relates to an adjustable tool for gripping and rotating a screw-on oil filter cartridge for an internal combustion engine.

Referring to FIG. 1, a screw-on type engine oil filter cartridge 2 has a generally cylindrical metal outer body 4 which is mounted on a car or truck engine 6 by a screw thread. As is well known, the oil filter removes particulate matter from oil used to lubricate the engine. Over time, the oil filter clogs and its efficiency diminishes. Periodically, the old oil filter is unscrewed from the engine and replaced by a new oil filter which is screwed to the engine. Typically, the top of the body 4 has a circumferential array of indents 8 to help an operator manually grip the oil filter when screwing or unscrewing.

The oil filter 2 may be difficult to screw or unscrew manually despite the indents 8. This may be due to dirt or residue oil on its body 4. Alternatively, the oil filter cartridge 2 may be awkwardly orientated or located within a cramped engine bay or seized to the engine. Hand tool suppliers have devised oil filter gripping tools with a handle or socket-type tools that are adapted to be coupled to, and rotated by, a driving tool such as a ratchet wrench hand tool. Often, the gripping tool or socket-type tool is designed to increases its grip on the body 4 while it screws or unscrews the oil filter cartridge 2.

Patent publication US2007/0131067 discloses an adjustable socket-type tool for attachment or removal of a screw-on type engine oil filter cartridge having a generally cylindrical body. The tool includes a pair of gripping jaws that are movably inter-connected for radial inward and outward relative movement, a pair of link rods each of which is connected at one end to a respective gripping jaw, an elongate base plate and a driving head located at a centre of an underside of the base plate. The other end of each link rod is connected to opposite ends of the base plate. A return spring tends to bias the gripping jaws together. In use, an operator, using both hands, pulls the gripping jaws apart and then releases them to grip the circumferential periphery of an oil filter cartridge. The operator couples a socket wrench to the driving head. Rotation of the driving head in either direction produces coordinated radial movement of the gripping jaws for progressive engagement with the oil filter cartridge to apply torque thereto. The adjustable disposition of the two gripping jaws enables the tool to be used with oil filter cartridges of all conventional sizes.

A drawback of the tool of U.S. Pat. No. 4,781,074 is that both the operator's hands are occupied while pulling the clamping arms apart locating them around circumferential periphery of an oil filter cartridge. A cramped engine bay may not have space for two hands around an oil filter cartridge. Also, the tool may fall off a replacement oil filter cartridge while it is being moved to its location on the engine. Typically, a weaker return spring is used so that two handed separation of the jaws is made easier in tight spaces. However, the operator must release one hand from the socket to connect the ratchet wrench. The tool is liable to fall off the oil filter cartridge.

According to the present invention, there is provided a tool for gripping and rotating a screw-on oil filter cartridge for an internal combustion engine, the tool comprising: a driving member having a longitudinal axis, wherein the driving member is either manually rotatable or connectable to a driving tool for rotation about the longitudinal axis; gripping jaws for gripping the body of an oil filter cartridge located between the gripping jaws, wherein the gripping jaws are movable in relation to each other for gripping oil filter cartridges having bodies of different sizes; a guide arrangement for guiding movement of the gripping jaws in relation to each other; biasing means for biasing the gripping jaws towards each other; and a driving mechanism coupled to the driving member and the gripping jaws for converting rotation of the driving member about the longitudinal axis into movement of the gripping jaws towards each other for engagement with an oil filter cartridge located between the gripping jaws and applying either screwing or unscrewing torque thereto, wherein the tool further comprises: a locking mechanism operable for releasably locking the gripping jaws at a pre-determined distance away from each other; and a release actuator operable for unlocking the locking mechanism and releasing movement of the gripping jaws towards each other.

The present invention alleviates the drawbacks of the prior art by providing a tool with gripping jaws which may be locked apart at a pre-determined distance which is wide enough to accommodate oil filter cartridges of all conventional sizes. Meanwhile, the operator can search for a screw-on oil filter cartridge mounted on a combustion engine which, as mentioned above, may be in a cramped or poorly lit engine bay. The operator is not hurried by the effort and irritation of holding the gripping jaws apart. When the oil filter cartridge is located, the operator slides it between the gripping jaws and operates the release actuator to grip the oil filter cartridge between the gripping jaws. Advantageously, this operation can be performed with only one hand holding the tool of the present invention. This makes cramped engine bays more accessible because one hand occupies less space. It is naturally more flexible than two hands. Also, it frees the other hand to steady the operator or hold a socket wrench in preparation for connection to the tool. A more robust biasing means may be used to hold the tool more firmly on the oil filter cartridge, thereby making it less likely to fall off.

Preferably, the locking mechanism is configured to set the driving mechanism for unscrewing an oil filter cartridge from an internal combustion engine upon operation of the locking mechanism. Unscrewing an oil filter cartridge from its mounting on an internal combustion engine is the most common operation in a cramped space. The tool of the present invention is prepared for this use.

Preferably, the locking mechanism is reconfigurable to set the driving mechanism for screwing an oil filter cartridge to an internal combustion engine. Screwing an oil filter cartridge to its mounting on an internal combustion engine is a common operation, albeit not one that is initiated in a cramped space. The tool of the present invention may be reconfigured for this use.

Preferably, the release actuator is operable by engagement between the release actuator and an oil filter cartridge between the gripping jaws. Operation of the release actuator occurs automatically upon engagement with the oil filter cartridge located between the gripping jaws.

Preferably, the release actuator is arranged to engage the body of an oil filter cartridge in a direction parallel to the longitudinal axis. Thus, the release actuator's direction of engagement is in line with operation of the driving member. This helps to make the tool of the present invention more ergonomic for the operator.

Preferably, the release actuator is movable in relation to the guide arrangement, wherein the locking mechanism comprises a profile with a recess secured to one of the guide arrangement or the release actuator and a tooth secured to the other of the guide arrangement or the release actuator, wherein the tooth being seated within the recess locks the gripping jaws at the pre-determined distance away from each other and wherein the tooth being unseated from within the recess as a result of engagement between the release actuator and the body of an oil filter cartridge releases the gripping jaws to move towards each other under the bias of the biasing means. Tooth and recess engagement is a compact detent arrangement which provides an effective means of locking the gripping jaws at the pre-determined distance away from each other ready for release.

Preferably, the tooth is biased against being unseated from within the recess. Positive engagement between the release actuator and the body of an oil filter cartridge may be required to release the gripping jaws from the pre-determined distance.

Preferably, the tooth is remote from the profile when the gripping jaws are not at the pre-determined distance away from each other.

Preferably, the locking mechanism comprises at least one additional recess and tooth. This helps to increase reliability of the locking mechanism.

Preferably, the release actuator is movable in relation to the driving mechanism. Thus, the driving mechanism may be decoupled from the release actuator movement.

Preferably, the driving mechanism comprises link rods and wherein each link rod is pivotally coupled to the driving member and a respective gripping jaw. Link rods provide a simple, reliable and reversible means of converting rotation of the driving member into translational movement of the gripping jaws.

Preferably, the gripping jaws comprise two gripping jaws guided by the guide arrangement for linear movement towards and away from each other. The guide arrangement helps to ensure that the gripping jaws move smoothly and reliably when moved by the driving means.

The present invention will be explained in more detail with reference to the following drawings, of which:

Referring to FIGS. 2 to 10, there will be described a new design of adjustable socket-type tool 10 with an automatic locking mechanism. The tool 10 comprises a pair of metal gripping jaws 12*a*, 12*b* each slideably connected to the underside of a metal guide arrangement 13 having guides 14*a*, 14*b* which permit and guide linear sliding movement of the gripping jaws relative to each other. The gripping jaws may be manually moved apart to fit around an oil filter cartridge. The metal gripping jaws are biased towards each other by a pair of return springs 16*a*, 16*b* so that they may grip the oil filter cartridge once the automatic locking mechanism is unlocked, as is described in more detail below.

The top end 18*a*, 18*b* of each gripping jaw 12*a*, 12*b* is pivotally connected to a respective driven pin 21*a*, 21*b* on the underside of one end of a respective link rod 20*a*, 20*b*. The other end of each link rod is pivotally connected to a respective drive pin 22*a*, 22*b* on the underside of a metal driving disc 24. The driving disc may be coupled to the output spindle of a ratchet wrench.

Figure 1:
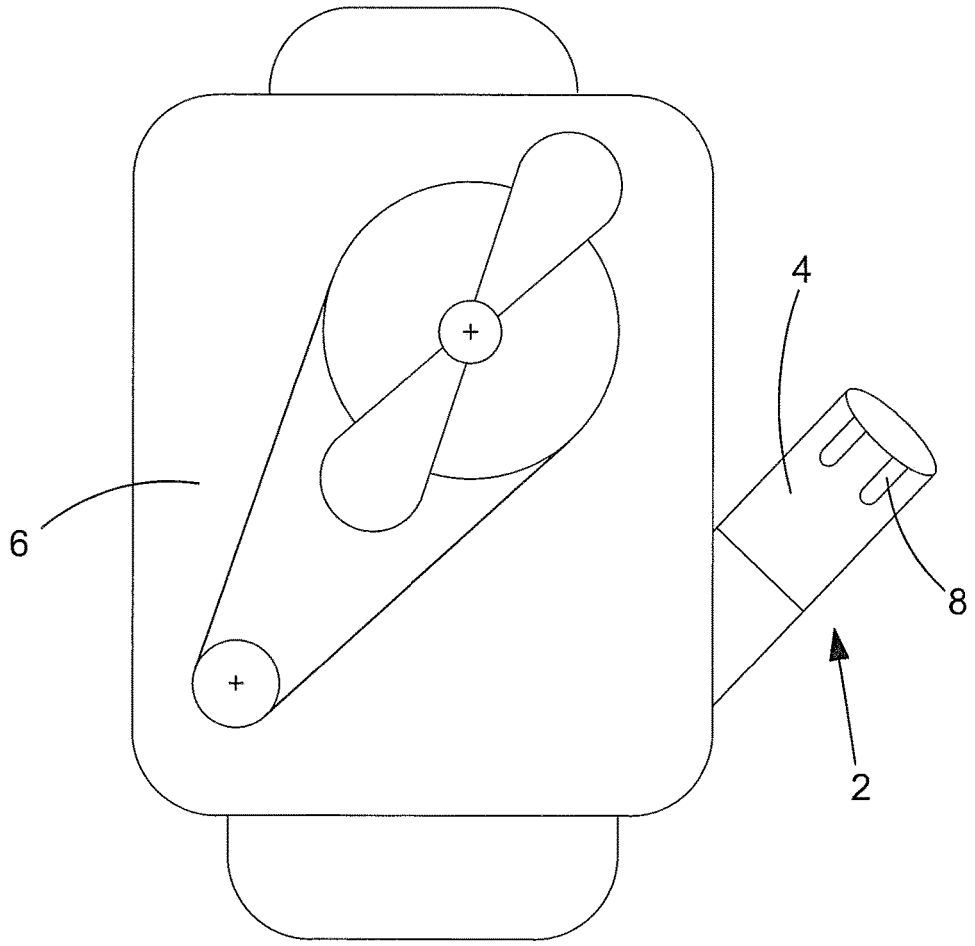
FIG. 1 shows a tops view of a general automobile engine according to the present invention for attachment or removal of a screw-on type engine oil filter cartridge.
Figure 2:
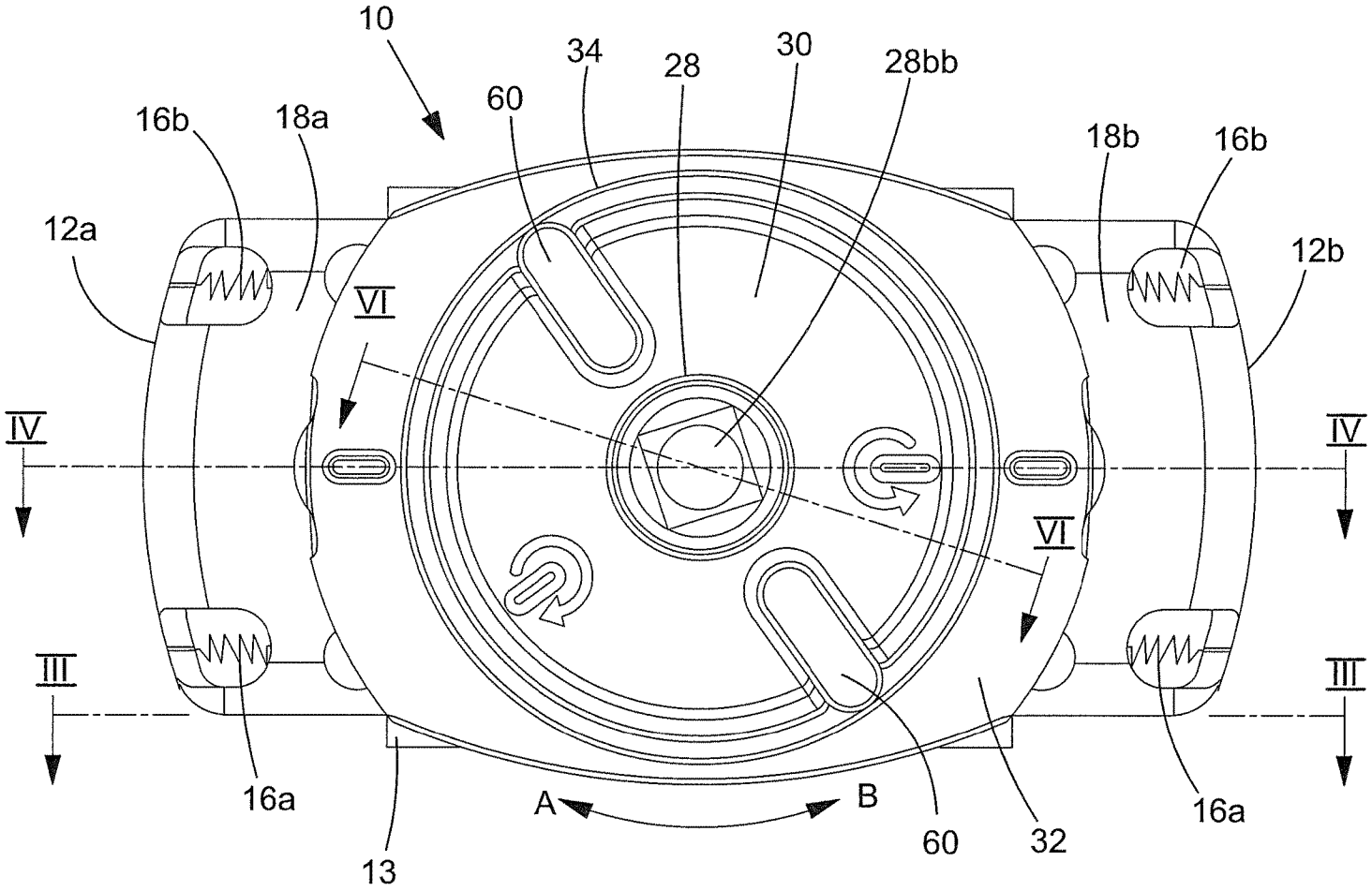
FIG. 2 shows a top view of an adjustable socket-type tool according to the present invention for attachment or removal of a screw-on type engine oil filter cartridge.
Figure 3:
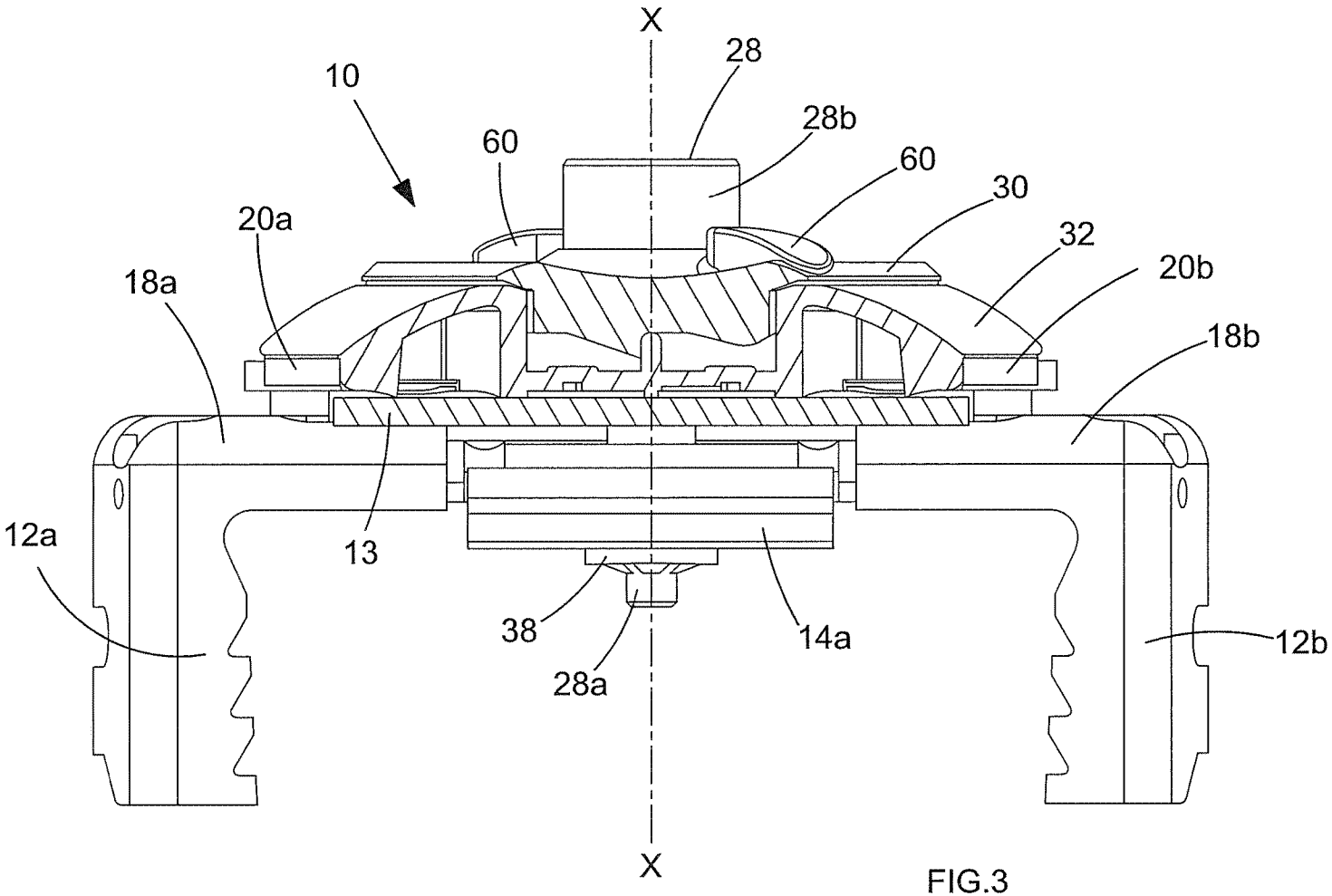
FIG. 3 shows a side cross-sectional view III-III of the tool of FIG. 2.
Figure 4:
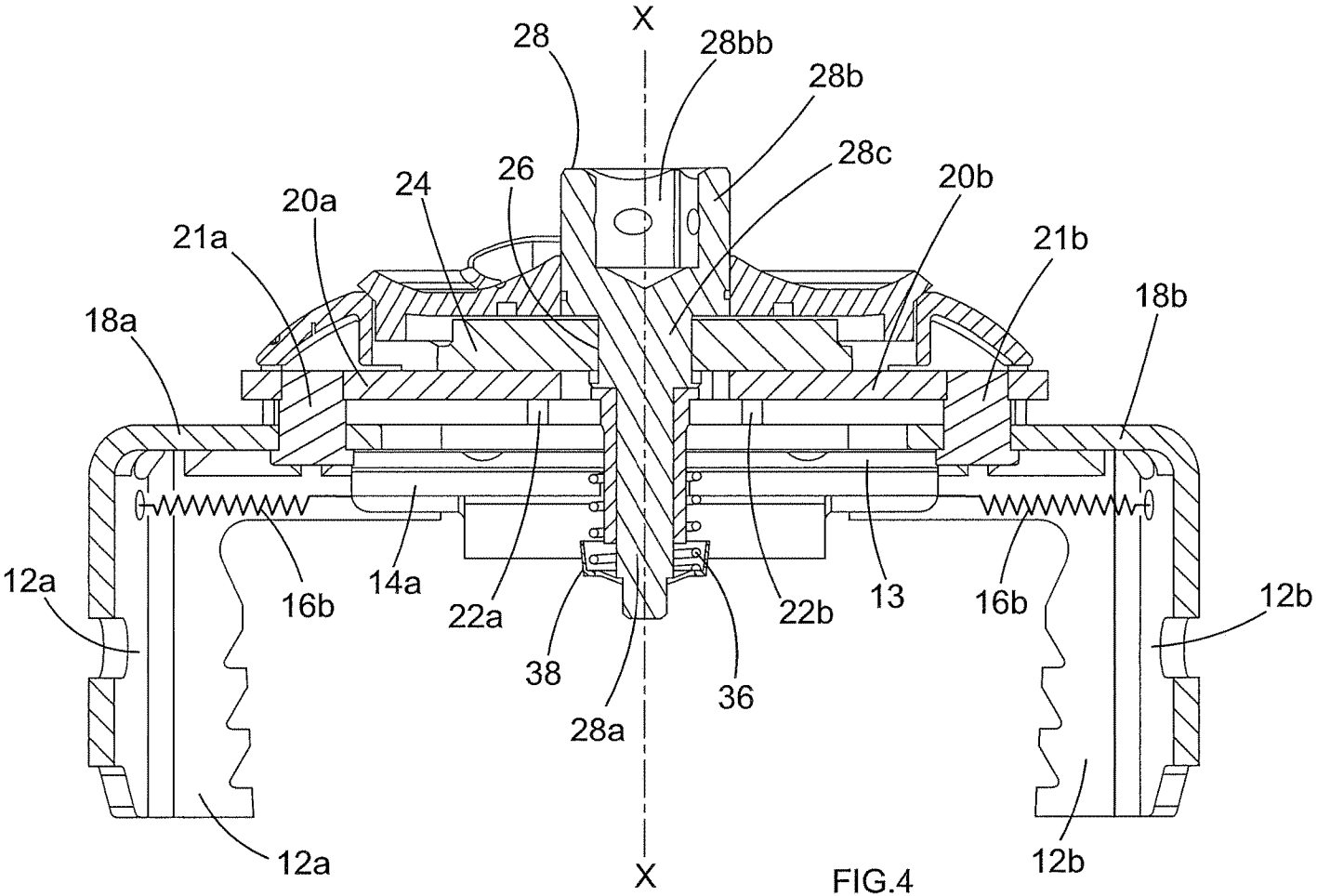
FIG. 4 shows a side cross-sectional view IV-IV of the tool of FIG. 2.
Figure 5:
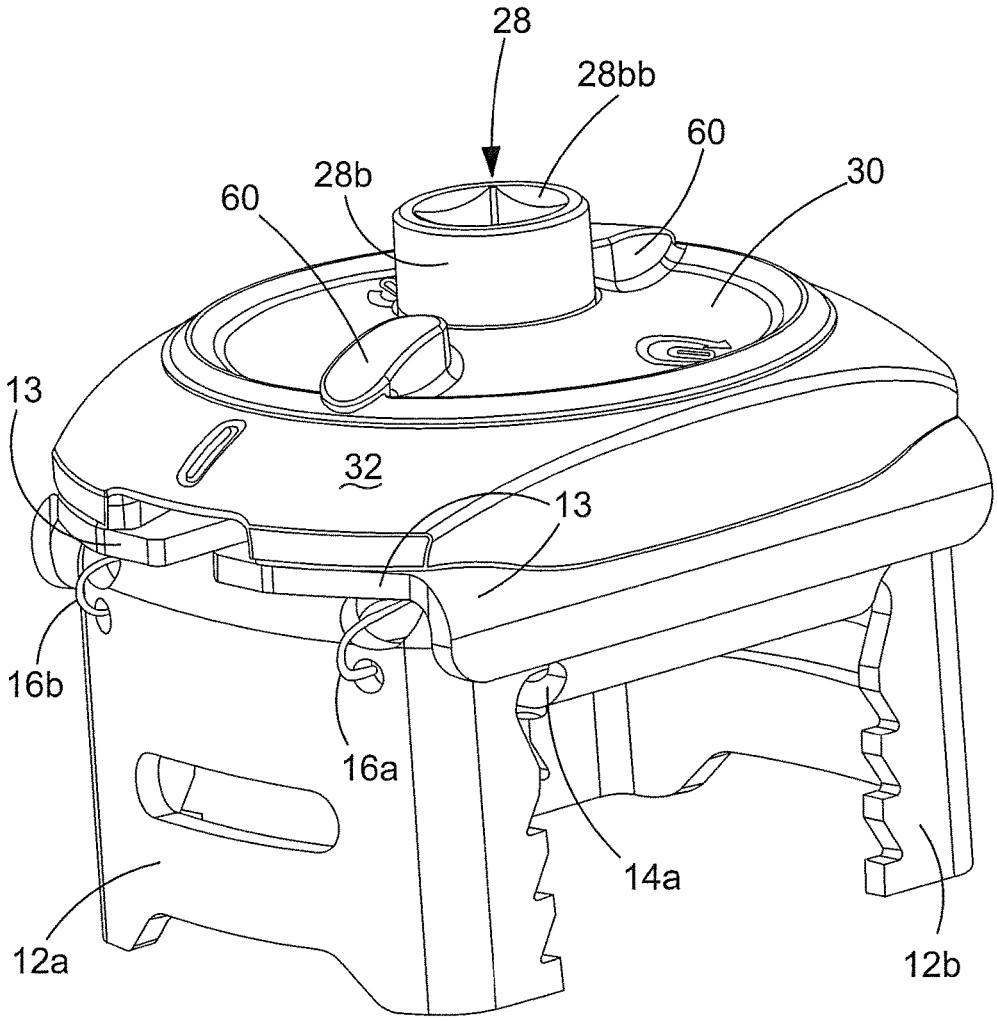
FIG. 5 shows a perspective view of the tool of FIG. 2 from above.
Figure 6:
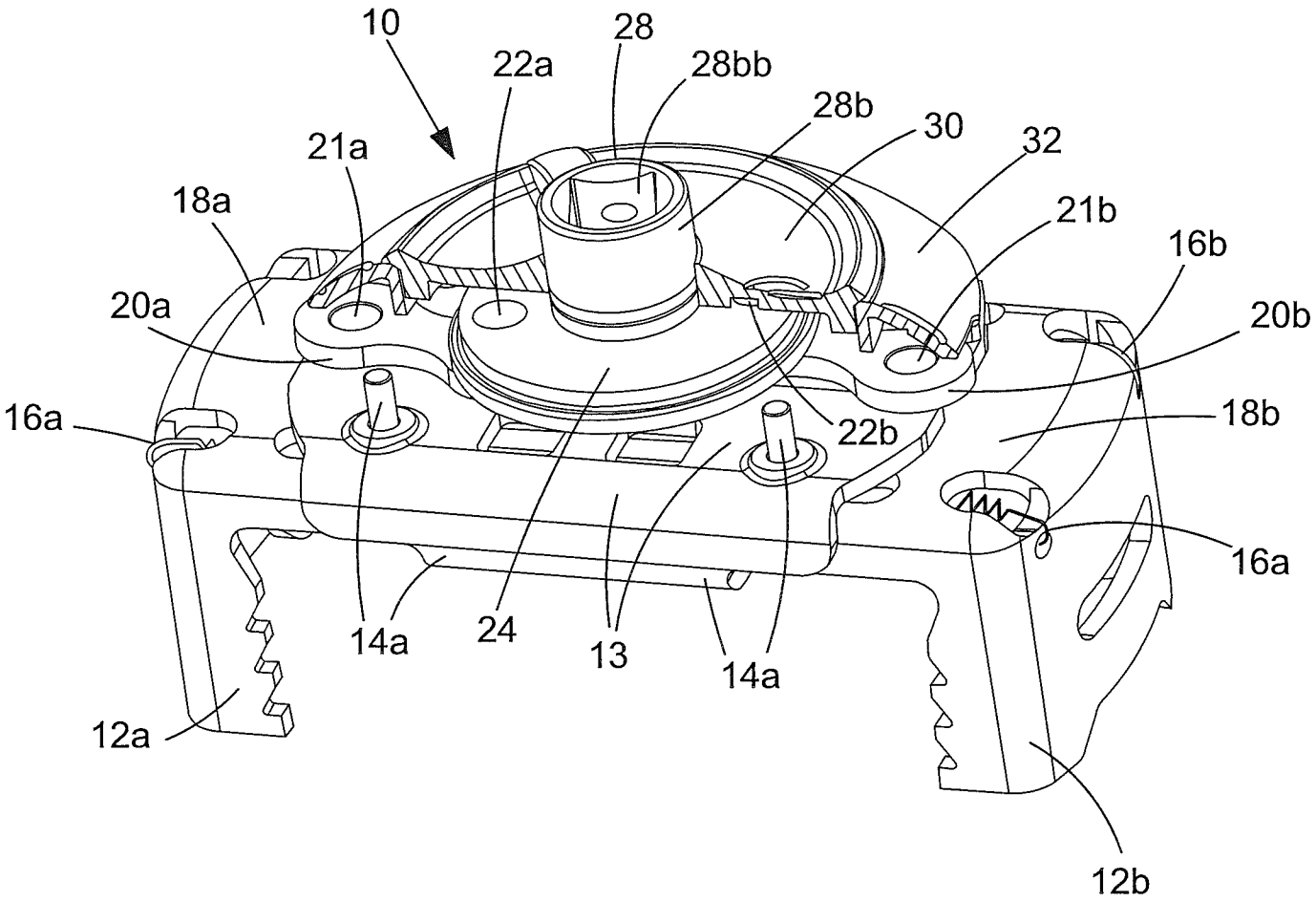
FIG. 6 shows a perspective view of the tool of FIG. 2 with cut-out VI.
Figure 7:
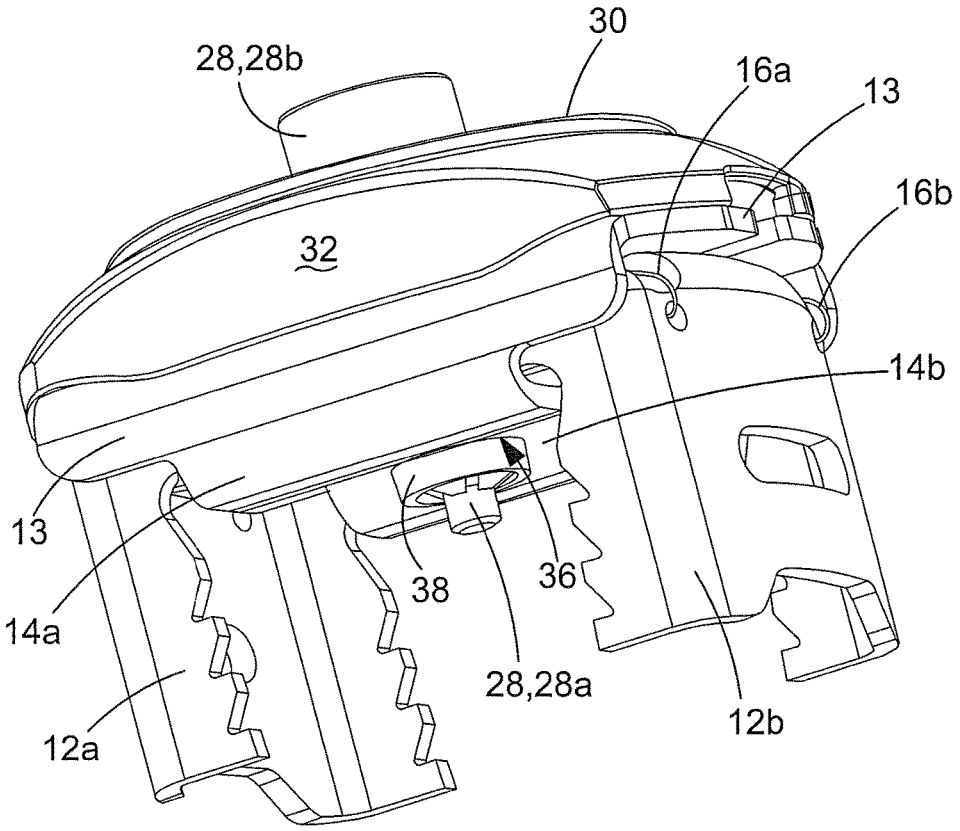
FIG. 7 shows a perspective view of the tool of FIG. 2 from below.
Figure 8:
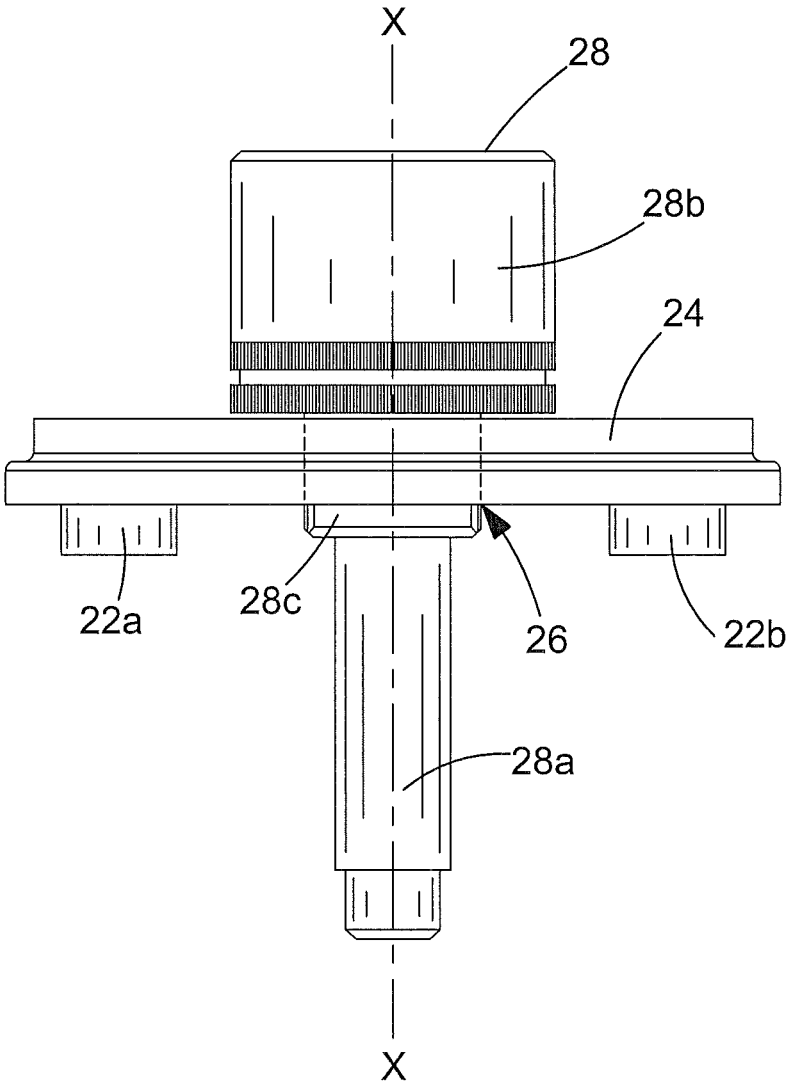
FIG. 8 shows aside elevation view of a driving spindle and driving disc of the tool of FIG. 2.

The driving disc 24 of the tool 10 has a square central hole 26 surrounding a central driving spindle 28 having a longitudinal spindle axis X-X. Referring to in particular to FIG. 8, the driving spindle has lower cylindrical section 28*a* and an upper cylindrical section 28*b* with a square blind hole 28*bb* into which the output spindle of a ratchet wrench may be inserted. In between the lower and upper cylindrical sections is a square waist section 28*c*. The square waist section 28*c* is sized to slidingly engage the square central hole 26 of the driving disc 24. The driving disc 24 may slide in the direction of spindle axis X-X along the length of the square waste section 28*c*. The square waist section 28*c* is rotatingly coupled to the square central hole 26 of the driving disc 24. The driving disc 24 rotates about the spindle axis X-X with the driving spindle 28. A plastic generally cylindrical cap 30 surrounds the upper cylindrical section 28*b* of the driving spindle 28. The cap 30 is rigidly connected to the spindle 28 coaxial with the spindle axis X-X and rotates with the spindle.

The pins 22*a*, 22*b* are on diametrically-opposed sides of the spindle axis X-X at the same radial distance from the spindle axis X-X. As is shown in particular in FIGS. 2 and 10, the driving spindle 28 and the cap 30 may be turned either clockwise, in the direction of arrow A, or anticlockwise, in the direction of arrow B, by a ratchet wrench coupled to the square blind hole 28*bb*. Clockwise or anticlockwise rotation of the driving spindle 28 rotates the driving disc 24 and the drive pins 22*a*, 22*b* around the spindle axis X-X which has the effect of wrapping the link rods 20*a*, 20*b* around the spindle axis X-X and pulling the driven pins 21*a*, 21*b* and the gripping jaws 12*a*, 12*b* closer together so that they grip an oil filter cartridge more tightly than can be achieved manually. In other words, rotation of the driving spindle's upper cylindrical section 28*b* in either direction produces coordinated radial movement of the gripping jaws 12*a*, 12*b* for progressive engagement with the oil filter cartridge 2 to apply torque thereto. The adjustable disposition of the two gripping jaws 12*a*,12*b* enables the tool 10 to be used with oil filter cartridges 2 of all conventional sizes. Clockwise rotation screws the oil filter cartridge to the engine. Anticlockwise rotation unscrews the oil filter cartridge from the engine.

Referring in particular to FIGS. 2 to 7, the tool 10 further comprises a plastic body 32 rigidly connected to the top of the guide arrangement 13. The top of the body 32 has an open mouth in the form of generally cylindrical recess 34. The cap 30 is biased downwardly into the recess 34 by a return spring 36 located in compression between the driving spindle 28 and the bottom of the guide arrangement 13. The return spring 36 is protected by a shroud 38.

Figure 9:
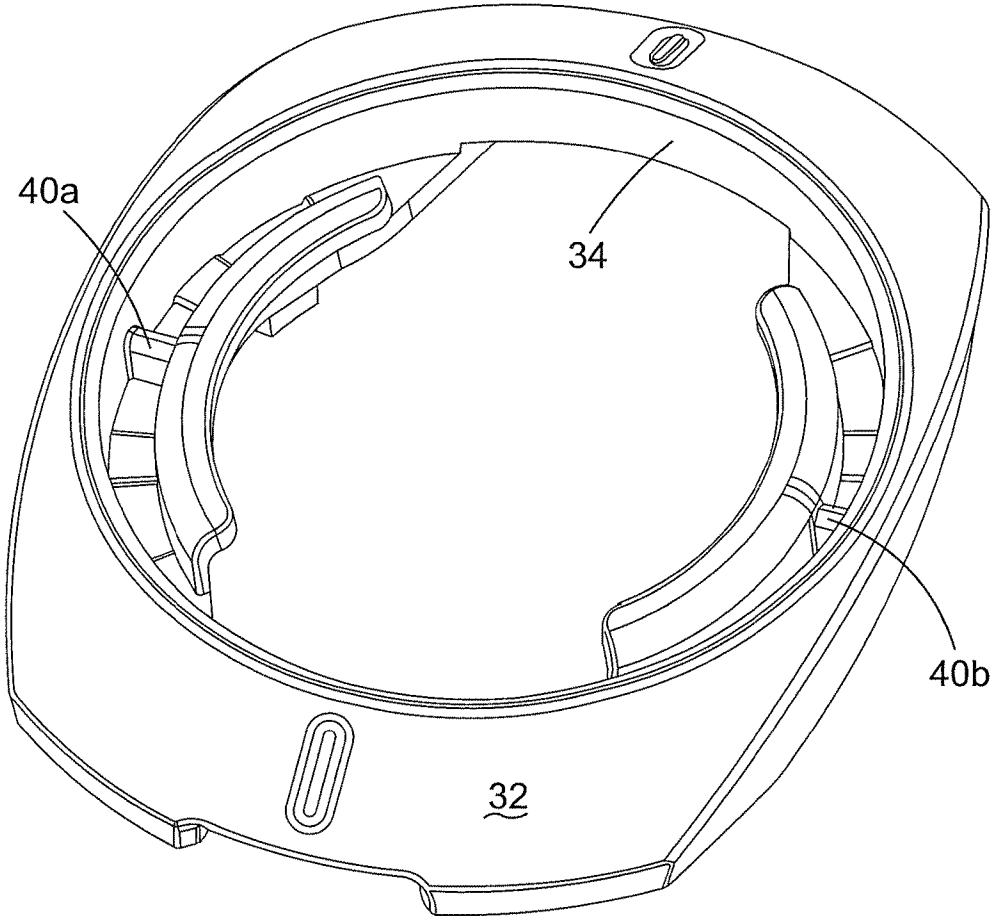
FIG. 9 shows a perspective view of a plastic body of the tool of FIG. 2 from above.
Figure 10:
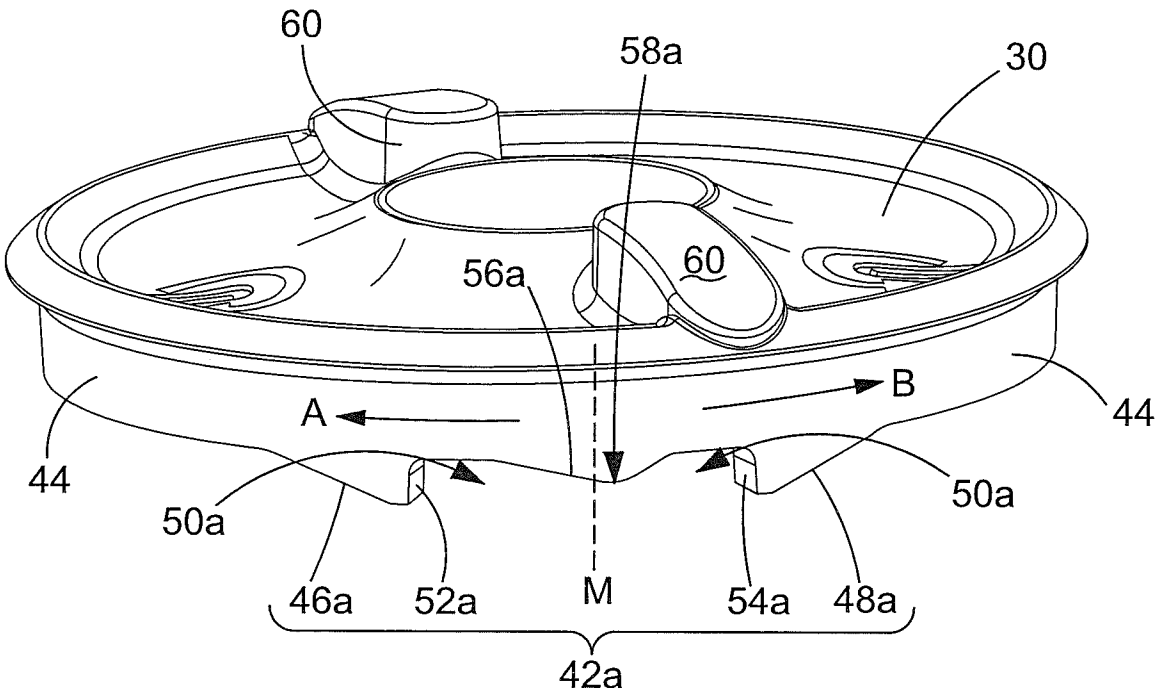
FIG. 10 shows a perspective view of cylindrical cap of the tool of FIG. 2 from above.

Referring to FIG. 9, the body 32 has a pair of diametrically-opposed teeth 40*a*, 40*b* at the circumference of the cylindrical recess 34. Referring to FIG. 10, the cap 30 has a pair of diametrically-opposed profiles 42*a* (42*b* not shown) in an otherwise regular cylindrical skirt 44 around the circumference of the bottom of the cap. The teeth 40*a*, 40*b* are biased by the return spring 36 to engage either the skirt 44, or a respective profile 42*a*, 42*b*, according to the rotational position of the cap.

Each of the profiles 42*a*, 42*b* has the same basic shape which, for brevity, will be described with reference to one profile 42*a* only. Transition between the regular part of the cylindrical skirt 44 and the profile 42*a* is defined by a clockwise cam surface 46*a* at the portion of the profile 42*a* which engages its respective tooth 40*a* when the cap rotates in the clockwise direction of arrow A. Transition between the regular part of the cylindrical skirt and the profile 42*a* is defined by an anticlockwise cam surface 48*a* at the portion of the profile 42*a* which engages said respective tooth 40*a* when the cap rotates in the anticlockwise direction of arrow B. The cam surfaces 46*a*, 48*a* are inclined with regard to the bottom of the cap 30. Said respective tooth 40*a* causes the cap 30 to progressively rise from the body 32 against the bias of the return spring 36 as the cap rotates in clockwise direction A, in the case of engagement between the tooth 40*a* and clockwise cam surface 46*a*, or as the cap rotates in the anticlockwise direction, in the case of engagement between the tooth 40*a* and anticlockwise cam surface 48*a*. Located between the cam surfaces 46*a*, 46*b* is a recess 50*a* in the profile 42*a*. The bottom of the recess 50*a* is roughly in line with the bottom of the skirt 44. The bottom of the recess is interrupted by a double-sloped projection 56*a* projecting away from the bottom of the cap. An apex 58*a* of the projection is slightly to one side of the mid-point M of the recess.

The automatic locking mechanism comprises the cap 30, the body 32, the driving spindle 28 which can slide along spindle axis X-X relative to the driving disc 24, and the return spring 36 which biases the cap 30 towards the body 32. Operation of the automatic locking mechanism shall be described in detail, again, for brevity, with reference to one tooth 40*a* and one profile 42*a*, it being understood that the other tooth 40*b* and profile 42*b* behave correspondingly.

When an operator pulls the gripping jaws 12*a*, 12*b* apart against the bias of the compression springs 16*a*, 16*b* the link rods 20*a*, 20*b* are pulled apart which causes the driving spindle 28 and the plastic cap 30 to rotate about the axis X-X. The tooth 40*a* slides along the cylindrical skirt 44 and the cap 30 remains seated within the recess 34 until the cap has rotated nearly 90 degrees upon which stage the tooth 40*a* encounters its respective profile 42*a*. Depending on the position from which the cap starts rotating and its direction, the tooth 40*a* slides along one of the cam surface 46*a*, 48*a*, causing the cap 30 to rise against the bias of the return spring 36 and un-seat itself from within the recess 34. At the end of the cam surface 46*a*, 48*a*, the tooth 40*a* falls into the recess 50*a* and collides with the projection 56*a*, and the cap 30 re-seats seats itself within in the recess 134 of the body 132, under the bias of the return spring 36. The automatic locking mechanism is set. The gripping jaws 112*a*, 112*b* are locked in an open position because a wall 52*a*, 54*a* at each circumferential edge of the recess confine said tooth 40*a* and, in doing so, prohibit all but minimal rotation of the cap 30, the driving spindle 28 and the driving disc 24 about axis X-X. The apex 58*a* tends to guide said tooth 40*a* to abut the wall 52*a* on the clockwise side of the recess 50*a*. This can be over-ridden by an operator who manually turns the cap 30 in the anticlockwise direction B, using finger holds 60, so that said tooth 40*a* abuts the wall 54*a* on the anticlockwise side of the recess 50*a* instead.

The socket 10 is now ready to fit around an oil filter cartridge 2. In doing so, the lower cylindrical section 28*a* of the driving spindle 28 abuts the cylindrical outer body 4 of the oil filter cartridge 2. This compresses the return spring 36 and raises the cap 30 from the body 32. The automatic locking mechanism is activated. The cap 30 un-seats itself from the recess 34 and the tooth 40*a* is freed from the confines of the walls 52*a*, 54*a* at the edges of the recess 50*a*. The gripping jaws 12*a*, 12*b* are unlocked from the open position and are permitted to close against the outer body 4 of the oil filter cartridge 2 under the bias of the compression springs 16*a*, 16*b*. The driven pins 21*a*, 21*b* move closer together with the gripping jaws 12*a*, 12*b* which pushes the link rods 20*a*, 20*b* closer together and wraps them and the drive pins 22*a*, 22*b* round spindle axis X-X. The drive pins rotate the cap 30, the driving spindle 28 and the driving disc 24 about the spindle axis X-X. The direction of rotation is pre-determined. If said tooth 40*a* abuts the wall 52*a* on the clockwise side of the recess 50*a*, then rotation of the cap 30, the driving spindle 28 and the driving disc 24 in the anticlockwise direction B has already partially started. The tool 10 is set for gripping and unscrewing an oil filter cartridge 2 from an engine. Conversely, if said tooth 40*a* abuts the wall 54*a* on the anticlockwise side of the recess 50*a*, then rotation of the cap 30, the driving spindle 28 and the driving disc 24 in the clockwise direction A has already partially started. The tool 10 is set for gripping and screwing an oil filter cartridge to an engine.

The automatic locking mechanism allows an operator to reliably connect the tool 10 to an oil filter cartridge 2 in awkward positions and with only one hand. The driving disc 24 of the tool 10 is set for rotation in either the anticlockwise direction B (default position) or the clockwise direction A (manual override required). When a ratchet wrench coupled to the upper cylindrical section 28*b* turns the driving spindle 28, the gripping jaws 12*a*, 12*b* pull together and grip an oil filter cartridge more tightly than can be achieved manually. Once the operation is complete, the operator disconnects the ratchet wrench from the square blind hole 28*bb* and slides the tool 10 from the oil filter cartridge 2. The tool 10 is ready to be re-set for re-use.

The invention claimed is:

1. A tool (10) for gripping and rotating a screw-on oil filter cartridge (2) for an internal combustion engine (6), the tool comprising:

a driving member (28, 28*b*) having a longitudinal axis (X-X), the driving member being rotatable about the longitudinal axis;

gripping jaws (12*a*, 12*b*) coupled to the driving member for gripping the body (4) of an oil filter cartridge (2);

a guide arrangement (13, 14*a*, 14*b*) coupled to the gripping jaws for guiding movement of the gripping jaws in relation to each other;

biasing means (16*a*, 16*b*) coupled to the gripping jaws for biasing the gripping jaws towards each other;

a driving mechanism (28, 28*c*, 24, 22*a*, 22*b*, 20*a*, 20*b*, 21*a*, 21*b*) coupled to the driving member (28*b*) and the gripping jaws (12*a*, 12*b*) for converting rotation of the driving member about the longitudinal axis (X-X) into movement of the gripping jaws towards each other for engagement with an oil filter cartridge (2) located between the gripping jaws and selectively applying screwing or unscrewing torque thereto;

a locking mechanism (30, 32, 28, 24) operable for releasably locking the gripping jaws (12*a*, 12*b*) at a predetermined distance away from each other; and a release actuator (28*a*) operable for unlocking the locking mechanism and releasing movement of the gripping jaws towards each other; and wherein the release actuator (28*a*) is movable in relation to the guide arrangement (13, 14*a*, 14*b*) and operable by engagement between the release actuator and an oil filter cartridge (2) located between the gripping jaws (12*a*, 12*b*), wherein the locking mechanism (30, 32, 28, 24) comprises a profile (42*a*) with a recess (50*a*) secured to one of the guide arrangement and the release actuator and a tooth (40*a*) secured to the other of the guide arrangement and the release actuator, wherein the tooth being seated within the recess locks the gripping jaws (12*a*, 12*b*) at the pre-determined distance away from each other and wherein the tooth being unseated from within the recess as a result of engagement between the release actuator and the body (4) of an oil filter cartridge (2) releases the gripping jaws to move towards each other under the bias of the biasing means (16*a*, 16*b*).

2. A tool (10) for gripping and rotating a screw-on oil filter cartridge (2) for an internal combustion engine (6), the tool comprising:

a driving member (28, 28*b*) having a longitudinal axis (X-X), the driving member being rotatable about the longitudinal axis;

gripping jaws (12*a*, 12*b*) coupled to the driving member for gripping the body (4) of an oil filter cartridge (2);

a guide arrangement (13, 14*a*, 14*b*) coupled to the gripping jaws for guiding movement of the gripping jaws in relation to each other;

biasing means (16*a*, 16*b*) coupled to the gripping jaws for biasing the gripping jaws towards each other;

a driving mechanism (28, 28*c*, 24, 22*a*, 22*b*, 20*a*, 20*b*, 21*a*, 21*b*) coupled to the driving member (28*b*) and the gripping jaws (12*a*, 12*b*) for converting rotation of the driving member about the longitudinal axis (X-X) into movement of the gripping jaws towards each other for engagement with an oil filter cartridge (2) located between the gripping jaws and selectively applying screwing or unscrewing torque thereto;

a locking mechanism (30, 32, 28, 24) operable for releasably locking the gripping jaws (12*a*, 12*b*) at a predetermined distance away from each other; and a release actuator (28*a*) operable for unlocking the locking mechanism and releasing movement of the gripping jaws towards each other; and wherein the release actuator (28*a*) is movable in relation to the guide arrangement (13, 14*a*, 14*b*) and arranged to engage an oil filter cartridge (2) in a direction parallel to the longitudinal axis (X-X), wherein the locking mechanism (30, 32, 28, 24) comprises a profile (42*a*) with a recess (50*a*) secured to one of the guide arrangement and the release actuator and a tooth (40*a*) secured to the other of the guide arrangement and the release actuator, wherein the tooth being seated within the recess locks the gripping jaws (12*a*, 12*b*) at the predetermined distance away from each other and wherein the tooth being unseated from within the recess as a result of engagement between the release actuator and the body (4) of an oil filter cartridge (2) releases the gripping jaws to move towards each other under the bias of the biasing means (16*a*, 16*b*).

* * * * *